US006253828B1

(12) United States Patent
Reiter

(10) Patent No.: US 6,253,828 B1
(45) Date of Patent: Jul. 3, 2001

(54) METHOD AND CASTING DEVICE FOR PRECISION CASTING

(75) Inventor: Christian Reiter, Tokyo (JP)

(73) Assignee: Shouzui Yasui, Tokyo (JP); a part interest ( * ) Notice: Subject to any disclaimer, the term of this patent is extended or adjusted under 35 U.S.C. 154(b) by 0 days.

(21) Appl. No.: 09/381,734

(22) PCT Filed: Mar. 17, 1998

(86) PCT No.: PCT/CH98/00103

§ 371 Date: Sep. 22, 1999

§ 102(e) Date: Sep. 22, 1999

(87) PCT Pub. No.: WO98/45071

PCT Pub. Date: Oct. 15, 1998

(30) Foreign Application Priority Data

Apr. 3, 1997 (CH) ..... 0765/97

(51) Int. Cl.[7] ..... B22D 27/15

(52) U.S. Cl. ..... 164/61; 164/66.1; 164/258; 164/259

(58) Field of Search ..... 164/61, 62, 66.1, 164/113, 312, 254, 255, 258, 259

(56) References Cited

U.S. PATENT DOCUMENTS

| | | | | |
|---|---|---|---|---|
| 5,335,711 | * | 8/1994 | Paine | 164/66.1 |
| 5,626,179 | * | 5/1997 | Choudhurry et al. | 164/66.1 |
| 5,634,514 | * | 6/1997 | Gagliano | 164/495 |
| 5,669,434 | * | 9/1997 | Nakao et al. | 164/97 |
| 5,934,355 | * | 8/1999 | Nakao et al. | 164/97 |

FOREIGN PATENT DOCUMENTS

| | | | |
|---|---|---|---|
| 0 293 961 A1 | * | 12/1988 | (EP) . |
| 53-012726 | * | 2/1978 | (JP) . |

* cited by examiner

*Primary Examiner*—Tom Dunn
*Assistant Examiner*—Lan Tram
(74) *Attorney, Agent, or Firm*—Notaro & Michalos P.C.

(57) ABSTRACT

For the production of precision cast objects a gas change method is used. A melting crucible (1) and a casting mold (2) with at least partially porous walls are disposed in a gastight receptacle (5). The casting mold (2) with the mold cavity (3) is evacuated before the pouring-in process and subsequently flushed with a light gas, for example helium. After the mold cavity (3) is filled, the surface level (18) of the melt in the casting mold (2) is acted upon by a second heavy gas, for example argon, and subjected to excess pressure. A better degree of filling of the mold cavity (3) and an improved structure of the cast object results.

11 Claims, 3 Drawing Sheets

METHOD AND CASTING DEVICE FOR PRECISION CASTING

FIELD AND BACKGROUND OF THE INVENTION

The invention relates to a method for casting metallic objects in a casting device for precision casting with at least one casting mold, one device for pouring liquid metal into the casting mold and with devices for generating vacuum and pressure and a casting device for carrying out this method.

By the term precision casting is understood the casting of jewelry, objects of art or decoration, as well as of precision hardware for the industry, in particular comprising gold, silver, platinum, bronze and other metals. Casting devices are known in which a melting crucible and a casting mold are disposed in a receptacle. The melting crucible is equipped with an inner cavity for receiving raw material and with a heating device, for example an electric induction device. As pouring means can be used the known possibilities with the known example comprising a bottom drainage with a stopper. Underneath the melting crucible is positioned the casting mold which comprises a gas-permeable porous material. The casting mold has a mold cavity which most often makes possible the casting of a multiplicity of discrete parts in the same casting step, i.e. the mold cavity has a tree structure with an inlet funnel. The production of the casting mold is most often carried out with the aid of a model comprising a synthetic material or wax and the mold can only be used once. The method for casting metallic objects in this known casting device is comprised of several steps. First, with the receptacle open the melting crucible is filled with raw material and the casting mold in set into the lower part of the receptacle. The lower part of the receptacle is separated from the upper part.

The upper receptacle part is connected to a device for generating excess pressure and the lower receptacle part with a device for generating a vacuum. To initiate the casting process the receptacle is closed gas-tight and the melting process is initiated in the melting crucible. By opening the stopper the liquid melt flows by casting from the top into the mold cavity of the casting mold until it is completely filled. Before and/or during the casting process the lower receptacle part in which the casting mold is disposed, is exposed to a negative pressure which also extends into the mold cavity due to the porosity of the casting mold material. At the end of the casting process, i.e. when the mold cavity is filled, an excess pressure is generated in the upper receptacle chamber such that this pressure acts also onto the surface level of the melt in the inlet gate of the casting mold. This combination of negative pressure acting onto the bottom and the shell of the casting mold and of excess pressure acting onto the melt in the mold cavity, compared to casting methods with bilaterally equal pressure, leads to better filling of the mold cavity and better molding of fine detail.

In spite of the casting results, which per se were good, with this known device, problems occur repeatedly, in particular in the case of complicated and delicate casting objects. The liquid melt can, for example, be distributed too slowly in the mold cavity. The consequence is that to some extent fine complicated branchings are not filled out or differing structures of the solidified metal occur since the cooling rate and the of solidification time are different in differing regions of the mold cavity.

SUMMARY OF THE INVENTION

It is therefore the task of the present invention to create a method and a device with which the molding accuracy and the degree of filling of the mold cavity can still be further increased and with which the structures of the cast objects are also improved.

This task is solved with a method according to the invention through the characterizing features of this and with a device according to the characterizing features of the invention. Advantageous further developments of the invention are evident based on the characteristics of the dependent patent claims.

In accordance with the method according to the invention, before the start of the casting process, i.e. before liquid melt is poured into the mold cavity, the mold cavity of the casting mold and the ambient space of the casting mold is exposed to negative pressure. Thereby the openings and passages in the most often partially porous and gas-permeable walls of the casting mold are evacuated and air or other gas residues are aspirated from these porous openings. The mold cavity and the ambient space of the casting mold is subsequently flushed with a light gas of low density which yields the advantage that this gas penetrates into the pores in the walls of the casting mold and fills it. As the light gas is chosen which in the periodic table of elements has an atomic number between 1 and 10 and which causes a throughflow rate of maximum possible magnitude of this gas through the pores in the wall of the casting mold. Especially suitable gas in this group is helium. After flushing the mold cavity and the ambient space of the casting mold with this light gas, a negative pressure is again generated at least in the mold cavity and subsequently the liquid melt is filled into the mold cavity. This filling process now takes place extraordinarily rapidly since the light gas, for example helium, is readily and rapidly displaced through the pores in the wall of the casting mold and can flow off toward the outside. This advantage is caused by the high throughflow rate of the selected light gas through pores and capillary openings. The advantage with respect to the casting process comprises that in the individual regions of the mold cavity and between the inflowing liquid metal no partial excess pressure is being built up so that the liquid metal can flow rapidly and unhindered into extremely fine branchings of the mold cavity. Thereby alone an improved accuracy of shape and increased casting rate is attained. One consequence is also the fact that in all regions in the mold cavity a better structure for the cast object is produced. As soon as the mold cavity is completely filled with liquid metal, the surface level of the melt in the inlet region of the mold cavity is acted upon with another heavy gas of greater density. Relative to the ambient space of the casting mold this gas has an excess pressure. As the heavy gas with greater density therein a gas is selected which in the periodic table of elements has an atomic number of at least 7 and in any event a higher atomic number than the light gas with which the flushing had been carried out in the preceding process step. The heavy gas can also be a gas mixture with the same properties. An especially suitable gas in this group is argon since it has the property of flowing only at a relatively low throughflow rate through the pores of the wall of the casting mold. Experiments have shown that the pressure equilibration between the the inner wall of the casting mold and the outer wall of the casting in the event one side is acted upon with argon, takes place 8–10 times slower than in the case in which helium is used. This yields the advantage that the liquid melt in the mold cavity of the casting mold can be exposed to an increased pressure without the negative pressure in the ambient space of the casting mold being markedly reduced. This leads to an even better filling of the mold cavities and and improved structure of the cast objects.

These advantages of the described method according to the invention are attained through a casting device which comprises two sources each for a different gas with different density. Further advantages can be obtained if the casting mold is disposed in a first gastight receptacle and the melting crucible and the pouring means are disposed in a second receptacle separate from the first. The two receptacles are connected via connection lines and control valves with the first, or second, gas source and pumps are available for generating a partial negative pressure or excess pressure, as well as corresponding control devices. If in the region between the pouring opening on the melting crucible and the inlet opening on the casting mold a third gas chamber is implemented, the advantage is obtained that this chamber is relatively small and thereby the pressure generation over the inlet opening after the filling of the casting mold can take place faster and less gas is required. In this case corresponding control and connection devices to the gas sources and/or to the first or second gastight receptacle are also provided.

Further advantages result if the region of the pouring opening of the melting crucible and the region of the inlet opening of the casting mold can be displaced relative to one another in the direction of the casting axis. This permits, on the one hand, better accessibility to the casting mold and to the melting crucible and, on the other hand, establishing a connection or separation of the first or second or third receptacle with/from one another. This can be accomplished by displacing the apparatus parts with the melting crucible or the apparatus parts with the casting mold relative to one another. For the purpose of sealing, at least one gastight seal is implemented between these apparatus parts.

Operation of the casting device according to the invention and application of the method according to the invention in this device take place usefully with a control which contains a control program for carrying out the method. Via this control the corresponding control valves and control devices between the gas sources and the gastight receptacles are controlled. This control can also assume the monitoring of the melting and pouring processes known per se.

BRIEF DESCRIPTION OF THE DRAWINGS

In the following, the invention will be explained in further detail in conjunction with embodiment examples with reference to the enclosed drawings. Therein depict.

DESCRIPTION OF THE PREFERRED EMBODIMENTS

Figure 1:
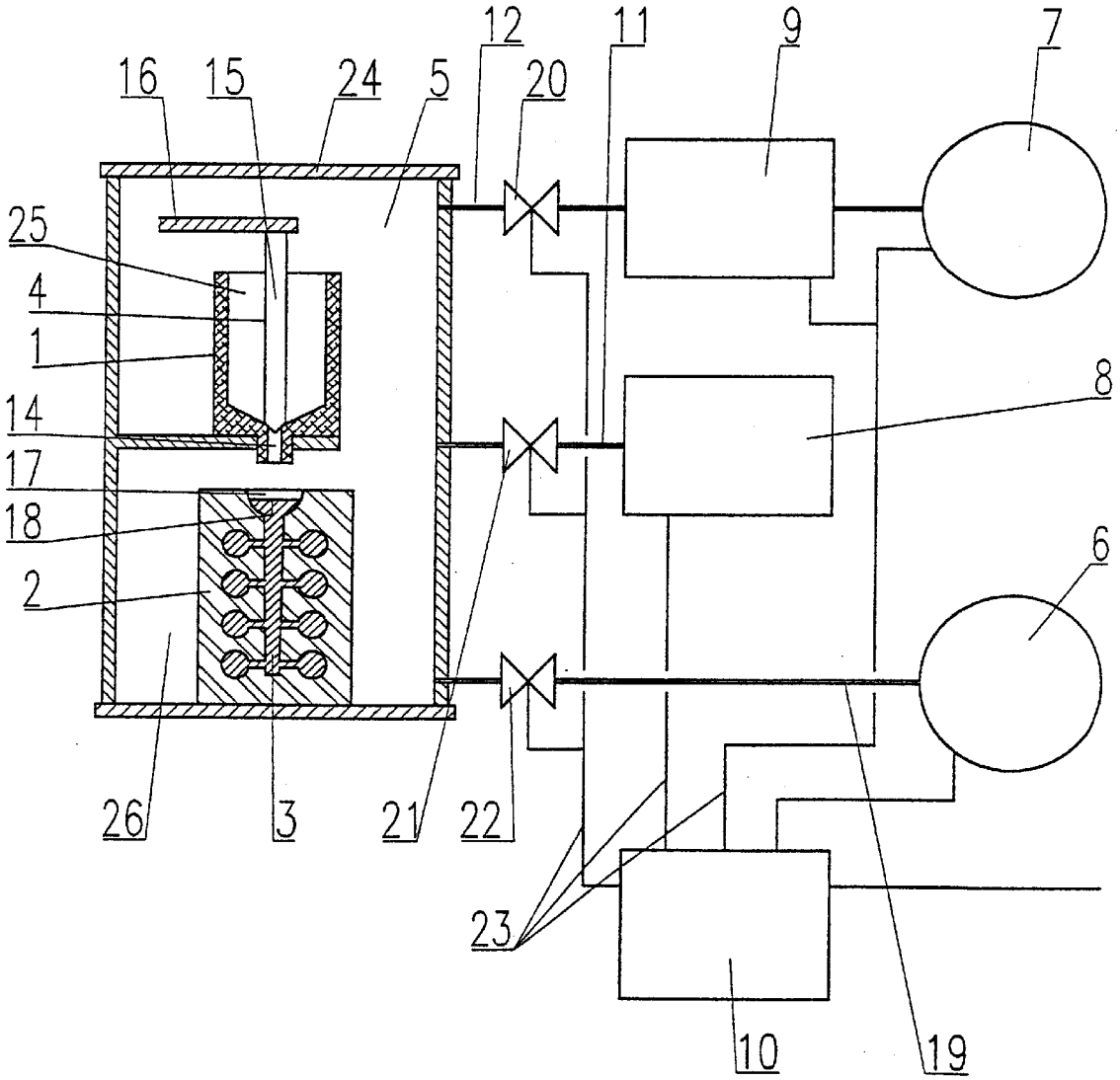
FIG. 1 a casting device according to the invention in schematic representation, FIG. 2 a casting device according to the invention with a first and a second receptacle, and FIG. 3 a casting device according to the invention with an additional third gas chamber.

The casting device depicted in FIG. 1 comprises a receptacle 5 with a cover 24 with the closure devices of this cover 24 not being shown. In the receptacle 5 a casting mold 2 with a mold cavity 3 is positioned. This casting mold 2 serves for the purpose of casting metallic objects, which, in the example represented, is jewelry. A multiplicity of objects is disposed about a central inlet channel with an inlet region 17 and form a treelike structure. The casting mold 2 comprises a porous mold material which is permeable to gas. The mold is produced in known manner with the aid of a wax model which, after the production of the casting mold 2, is melted out. Above the casting mold 2 a melting crucible 1 is positioned on an intermediate support. This melting crucible 1 comprises a reservoir 25 for raw material or molten metal and a pouring opening 14 in the bottom region of the melting crucible 1. This pouring opening 14 is closed with a stopper 15 and can be opened and closed with an actuation means 16 through operating elements not shown but known per se. About the melting crucible 1 is disposed a heating device in the form of an induction coil which, in the example depicted, is also not shown but is known per se. The stopper 15 and the pouring opening 14 as well as the actuation means 16 form the pouring means 4. The interior volume 26 of receptacle 5 is closed with the aid of a cover 24. The interior volume 26 forms simultaneously the ambient space for the casting mold 2. A connection line 19 connects this interior volume 26 with a first gas source 6, for example a compressed gas tank, containing helium. In the connection line 19 is disposed a valve 22 which comprises operating elements and which is connected via control lines 23 with a control 10. Via a further connection line 11 the interior volume 26 of the first receptacle 5 is connected with a vacuum pump 8 which is also connected via a control line 23 with the control 10. In the connection line 11 is also installed a valve 21 with operating elements and control lines to the control 10. The vacuum pump 8 can additionally be supplemented with a vacuum tank not shown.

Via a further connecting line 12 the interior volume 26 of receptacle 5 is connected with a second gas source 7, which, in the example described, contains argon. Between the second gas source 7 and the first receptacle 5 an excess pressure device 9, for example in the form of a pressure pump and a valve 20, is installed with these elements, in turn, being connected via control lines 23 with the control 10.

In the example depicted in FIG. 1 the mold cavity 3 of the casting mold 2 is filled with metal and in the inlet region 17 the surface level 18 of the poured-in melt is evident. The filling of the mold cavity 3 with liquid melt takes place according to the following process. In a first step the casting mold 2 is placed into the receptacle 5 and the reservoir 25 of the melting crucible 1 is filled with the necessary quantity of raw material. For casting pieces of jewelry raw materials such as gold, silver or platinum are normally used and other materials can also be used and other objects, such as for example art objects or industrial hardware can also be poured. The volume of the melting crucible 1 is therein approximately between 5 to 2000 $cm^3$. The receptacle 5 is subsequently closed with the cover 24 so as to be gastight and the metal present in the melting crucible 1 is melted with the aid of the heating device not shown. During or after completion of the melting process the entire interior volume 26 of receptacle 5 is evacuated with the aid of a vacuum pump 8 to a negative pressure of at least 100 mbars. Thereby the air which has entered during the filling of receptacle 5 is aspirated out of the interior volume 26 and the mold cavity 3 and also the pores in the walls of the casting mold 2 are evacuated. As soon as a desired, predetermined negative pressure has been attained, a light gas of low density, in the example described helium, is introduced via a valve 22 from the first gas source 6 into the interior volume 26 of the receptacle 5 and, in particular, the mold cavity 3 is flushed with this light gas. For this purpose, via the pump 8 a slight negative pressure can furthermore be maintained such that the flushing of the entire casting mold 2 is ensured. During this flushing process with the light gas helium, this gas also penetrates into the pores in the walls of the casting mold 2 and fills them. Since helium readily penetrates into pores and capillary openings and has high throughflow rates, the entire body of the casting mold 2 is relatively rapidly pervaded by helium. As soon as this state has been reached, valve 22 is closed and, while maintaining a slight negative pressure in the interior volume 26 of the first receptacle 5, the stopper 15 is opened. Thereby the molten metal flows via the pouring opening 14 into the inlet region 17 on the casting mold 2 until the mold cavity 3 is filled. Now valve 21 is also closed and, instead, valve 20 is opened and the interior volume 26 of the receptacle 5 is filled with a heavy gas, in the example described argon. Via the excess pressure device 9 an excess pressure of 1000 mbars is generated and this excess pressure acts directly on the surface level 18 of the melt in the mold cavity 3. This presses the melt in the mold cavity 3 into the outermost regions of the mold cavity 3 and the light gas helium is completely displaced from the mold cavity 3. The heavy gas argon has the property that it penetrates only very poorly into the pores of the casting mold 2 and therefore the pressure build-up at first acts only onto the surface level 18 of the melt in the mold cavity and only to a lesser extent via the walls as counterpressure. As soon as the melt in the mold cavity 3 has solidified, valve 20 is closed and, after carrying out a pressure equilibration process, the cover 24 can be opened and the casting form 2 can be removed from receptacle 5. Therewith the device is ready for a new casting process with a new empty casting mold 2. The control of the entire casting process takes place via a control 10, for example a control computer which is equipped with a corresponding control program and an input device. Depending on the material to be cast and on other casting parameters, the program, and thus the casting process, can be adapted to the corresponding basic conditions. When using different gases in the first or the second gas source 6, 7 these changes are also taken into consideration by the control 10.

Figure 2:
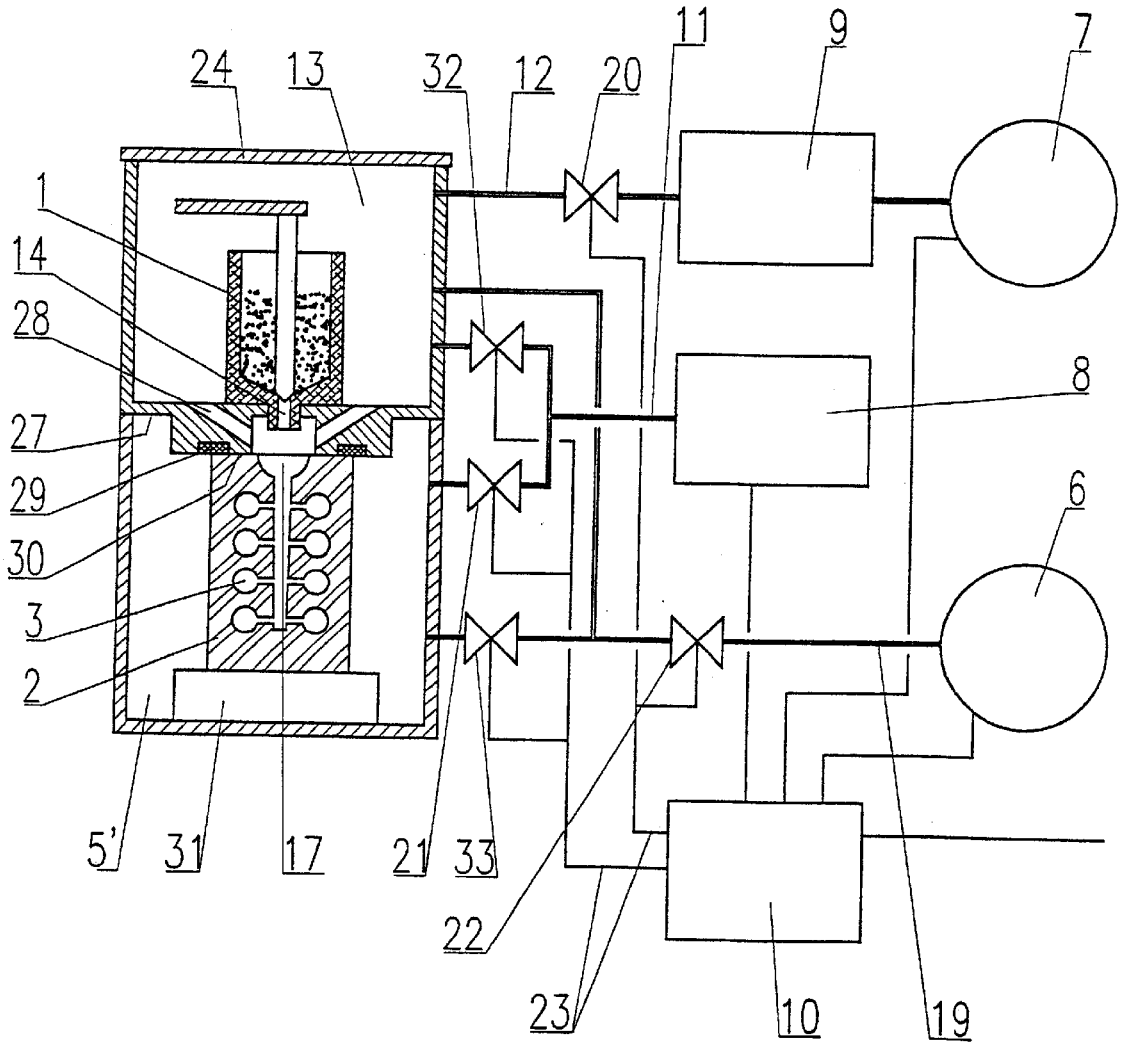

FIG. 2 shows an example of a casting device for precision cast parts which, relative to the example according to FIG. 1, has advantageous additions. The casting device comprises two receptacles, namely a first receptacle 5', which receives the casting mold 2, and a second receptacle 13 which receives the melting crucible 1. The two receptacles 5' and 13 can be connected gastight one with the other with the corresponding connection devices not being depicted. On the second receptacle 13, again, a cover 24 is disposed which can be connected via connection means, also not shown, gastight with the receptacle 13. Receptacle 13 comprises a bottom 27 in which at least one connection channel 28 is disposed. The bottom 27 of the second receptacle 13 is in contact on the upper face 30 of the casting mold 2 via a sealing 29. The casting mold 2, in the example depicted, is placed onto a lifting and lowering device 31, by means of which the casting mold 2 can be moved toward the bottom 27 and thus toward the pouring opening 14 or can be moved away from it. It is thereby possible to connect the interior volume of the first receptacle 5' with the interior volume of the second receptacle 13 via the connection channels 28 if the casting mold 2 is lowered and no longer is in contact on sealing 29. Into the melting crucible 1 molten raw material has not yet been filled, i.e. the initial state is depicted before the start of the melting process and of the pouring-off process.

After melting the raw metal in the melting crucible 1 the two interior volumes of the first receptacle 5' and of the second receptacle 13 are evacuated to a predetermined pressure via the vacuum pump 8 and the connection line 11. The interior volume of receptacle 5' forms the ambient space of the casting mold 2. The generation of the negative pressure in the mold cavity 3 takes place via the interior volume of the second receptacle 13 and the connection channels 28 which terminate in the inlet region 17 of the casting mold 2. In addition to valve 21, in this configuration a second valve 32 is disposed in the connection line 11, which connects the pump 8 with the interior volume of the second receptacle 13. When the casting mold 2 is in contact on the sealing 29 on bottom 27, both valves 21 and 32 are opened for the evacuation in order to generate in the first receptacle 5' as well as also in the second receptacle 13 the desired negative pressure and to aspirate the undesired gases from the mold cavity 3. Evacuating can also be carried out with the casting mold 2 lowered in which case only one of the two valves 21 or 32 must be opened. In this case the casting mold 2 is moved with the aid of device 31 toward the sealing 29 before starting the pouring-off process. After the desired negative pressure has been attained, valve 22 is opened and from the first gas source 6 a light gas is introduced into receptacles 5' and 13. In this example helium is also used as the light gas with low density. The time required until the light gas has flown through and filled the pores of the casting mold 2 is a function of the size of the casting mold 2 and the selected mold material. As soon as the pores are flushed and filled with helium, the flushing process is interrupted by closing the valve 22. As an improvement of the flushing process, an additional valve 33 can be installed. In this case the valve 32 is closed during the flushing process and the generation of a negative pressure in the ambient space of the casting mold 2 is continued via valve 21. The light gas helium flows subsequently into the second receptacle 13 and, via the connection channels 28, into the mold cavity 3 and penetrates the casting mold 2 from the inside toward the outside. In both variants valve 21 is closed before the start of the pouring-off process and only via valve 32 a predetermined negative pressure is maintained in the mold cavity 3. As soon as the mold cavity 3 is filled with liquid melt, valve 32 is also closed and valve 20 is opened. From the second gas source 7 and via connection line 12 the heavy gas, in the example shown this is again argon, is introduced into the interior volume of the second receptacle 13 and this heavy gas argon acts, via connection channels 28, upon the surface level of the melt in the inlet region 17 of the mold cavity 3. Via the excess pressure device 9 now in the second receptacle 13, relative to the ambient space of the casting mold 2 in the first receptacle 5', an excess pressure is built up. This, in turn, causes the liquid melt in the mold cavity 3 to penetrate into the outermost regions of the mold cavity 3 since the light gas helium flows off through the pores of the casting mold 2 into the ambient space without great resistance. Since here the heavy gas argon only acts upon the inlet region 17 of the mold cavity 3, the flowing of the lighter gas helium out of the mold cavity 3 into the ambient space of the receptacle 5' is facilitated since no excess pressure is being built up around the casting mold 2.

Figure 3:
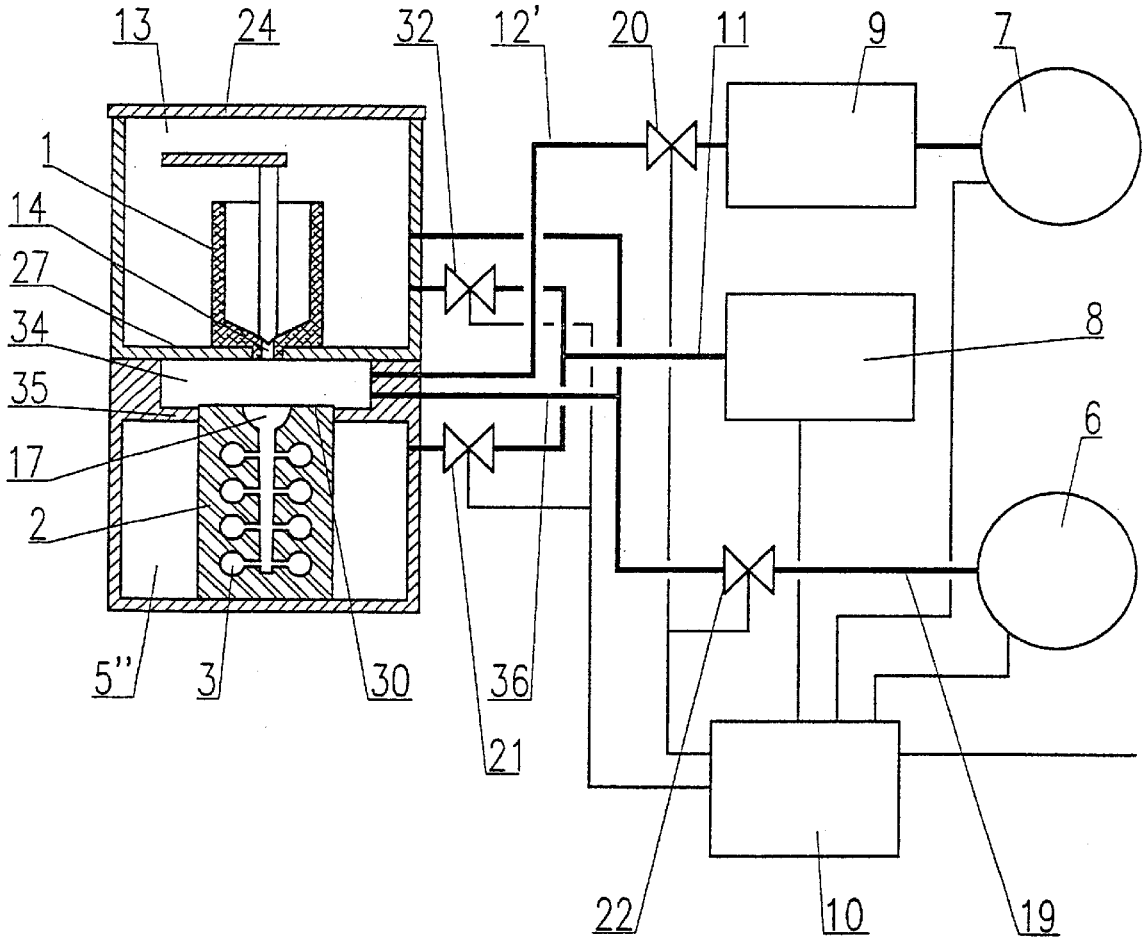

FIG. 3 depicts a further improved embodiment example in which between the first receptacle 5" and the second receptacle 13 a third gas chamber 34 is implemented. This third gas chamber 34 is implemented between the bottom 27 of the second receptacle 13 and a separating wall 35 on the first receptacle 5". This separating wall 35 seals the upper face 30 of the casting mold 2 against the ambient space in the first receptacle 5". The first receptacle 5" and the second receptacle 13 as well as cover 24 in this embodiment example are also connected gastight via (not shown) connection means. Before the pouring-off process is started, with the aid of the vacuum pump 8 and by opening valves 21 and 32 a desired negative pressure of 60 mbars is generated in the two interior volumes of the two receptacles 5" or 13. Through the pores in the walls of casting mold 2 the mold cavity 3, and thus the third gas chamber 34, is also evacuated. Therewith this embodiment offers the additional advantage that the air or other gases present in the mold cavity 3 are aspirated toward the outside in any event. Building up the same negative pressure in receptacle 13 is necessary in order to prevent undesired gases to flow into the third gas chamber 34. After the desired negative pressure is reached, valve 22 is opened and from the first gas source 6 via line 19 the light gas in the form of helium is introduced into the interior volume of receptacle 13 and the third gas chamber 34. An additional connection line 36 is disposed between line 19 and the third gas chamber 34. Valve 21 remains open so that, due to the negative pressure in the ambient space of the casting mold 2 in the first receptacle 5", the helium flows from the third gas chamber 34 via the mold cavity 3 toward the outside into the ambient space of the casting mold 2. This ensures the complete flushing of the pores and capillary openings in the walls of the casting mold 2 so that these are filled completely with helium. As soon as this condition has been reached, valve 22 in line 19 is closed and the liquid melt can now be poured into the mold cavity 3 in the manner already described. As soon as the mold cavity 3 is filled with liquid melt, to the third gas chamber 34 is supplied the heavy gas in the form of argon directly via connection line 12'. This, again, takes place via valve 20, the second gas source 7 and the excess pressure device 9. The desired excess pressure, in this example of 3000 mbars, relative to the ambient space of the casting mold 2 in the first receptacle 5", is only being build up in the third gas chamber 34. Since this third gas chamber 34 can be kept small, only a small quantity of argon is required and the generation of the desired excess pressure can also take place very rapidly and with low energy expenditures. This implementation of the casting device leads to the optimization of the casting method according to the invention and the gas consumption of the heavy as well as also of the light gas is reduced to a minimum.

Instead of the gas change combination helium/argon used in the examples, different other combinations are possible. If pure gases are used, combinations such as nitrogen/argon or helium/nitrogen, for example, are possible. With mixed gases, for example, a combination of nitrogen as the light gas and with carbon dioxide as the heavy gas can be used.

What is claimed is:

1. A method for casting metallic objects in a casting device for precision casting, the casting device having at least one porous casting mold (2) in an ambient space, the casting mold having pores and a mold cavity (3), a pouring device (4) for pouring liquid metal into the casting mold (2) during a casting process and devices for generating vacuum and pressure, the method comprising: generating a negative pressure in the mold cavity (3) and in the ambient space of the casting mold (2) before the casting process is started; flushing the mold cavity (3) and the ambient space of the casting mold (2) with a light gas of low density; at least partially filling the pores in the casting mold (2) with the light gas during the flushing step; subsequently generating a negative pressure at least in the mold cavity (3); subsequently pouring the liquid melt into the mold cavity (3) to fill the mold cavity (3) to a surface level (18) in an inlet region of the mold cavity (3); after filling the mold cavity (3) to the surface level (18) of the melt in the inlet region (17) of the mold cavity (3), acting upon the surface with a different heavy gas of higher density than the light gas; and generating in the heavy gas, an excess pressure relative to a pressure in the pores of the casting mold (2).

2. A method as claimed in claim 1, wherein the light gas is a gas whose density is lower by at least a factor of 1.2 to the density of the heavy gas.

3. A method as claimed in claim 1, wherein the light gas is a gas from the periodic table of elements with an atomic number of 1 to 10, and the heavy gas is a gas from the periodic table with an atomic number of at least 7, with the heavy gas having a higher atomic number than the lighter gas.

4. A method as claimed in claim 1, wherein, before the casting process is started a negative pressure of at least 100 mbars is generated and at the end of the casting process in the heavy gas an excess pressure relative to the pressure in the cavities of the pores of the casting mold (2) of at least 10 mbars is generated.

5. A casting device for precision casting of metallic objects, comprising: a melting crucible (1) having pouring means (4) for pouring a metal melt from the crucible; at least one casting mold (2) with a mold cavity (3), the casting mold (2) comprising a material which is at least partially permeable to gas; a gas-tight receptacle (5) for containing the casting mold (2) and said crucible; a first gas source (6) of light gas connected to the receptacle for flushing the receptacle (5); a second gas source (7) of heavy gas connected to the receptacle (5); a pump (8) with a first connection line (11) connected to the receptacle (5) for generating a negative pressure in the receptacle (5); a second connection line (12) between receptacle (5) and second gas source (7); and a device (9) connected to the receptacle (5) and to the second gas source (7) for generating excess pressure of the heavy gas in the receptacle (5).

6. A casting device as claimed in claim 5, wherein the melting crucible (1) and the pouring means (4) are disposed in a second gas-tight receptacle (13), the second gas-tight receptacle (13) being connected via a valve (20) and the second connection line (12) to the device (9) for generating excess pressure.

7. A casting device as claimed in claim 5, including a gas chamber (34) between a pouring opening (14) of the pouring means (14) on the melting crucible (1) and an inlet opening (17) of the casting mold (2).

8. A casting device as claimed in claim 5, including means for displacing a region of a pouring opening (14) of the melting crucible (1) and a region of an inlet opening (17) of the casting mold (2) relative to one another in a direction of an axis of the casting mold.

9. A casting device as claimed in claim 8, including at least one gas-tight seal (29) disposed between the region of the pouring opening (14) of the melting crucible (1) and the region of the inlet opening (17) of the casting mold (2).

10. Casting device as claimed in claim 7, wherein the gas chamber (34) is connected either via a connection line (12') with the device (9) for generating excess pressure, or via a connection line (36) with the first gas source (6), or both.

11. A casting device as claimed in claims 5, including a control (10) with a control program and control valves (20, 21, 22, 32) in the connection lines for controlling a flow of gases in the lines for performing the steps of: generating a negative pressure in the mold cavity (3) and in the ambient space of the casting mold (2) before a casting process is started; flushing the mold cavity (3) and the ambient space of the casting mold (2) with the light gas; at least partially filled the pores in the casting mold (2) with the light gas during the flushing step; subsequently generating a negative pressure at least in the mold cavity (3); subsequently pouring the metal melt into the mold cavity (3) to fill the mold cavity (3) to a surface level (18) in an inlet region of the mold cavity (3); after filling the mold cavity (3) to the surface level (18) of the melt in the inlet region (17) of the mold cavity (3), acting upon the surface with the heavy gas; and generating in the heavy gas, an excess pressure relative to a pressure in the pores of the casting mold (2).

* * * * *